US011627822B2

(12) United States Patent
Uribe

(10) Patent No.: US 11,627,822 B2
(45) Date of Patent: Apr. 18, 2023

(54) ANTI-WRINKLE ANATOMIC PILLOW

(71) Applicant: Marcela Uribe, Ciudad de Panamá (PA)

(72) Inventor: Marcela Uribe, Ciudad de Panamá (PA)

(73) Assignee: Marcela Uribe, Ciudad de Panamá (PA)

( * ) Notice: Subject to any disclaimer, the term of this patent is extended or adjusted under 35 U.S.C. 154(b) by 120 days.

(21) Appl. No.: 16/962,915

(22) PCT Filed: Nov. 28, 2019

(86) PCT No.: PCT/IB2019/060300
§ 371 (c)(1),
(2) Date: Jul. 17, 2020

(87) PCT Pub. No.: WO2020/148583
PCT Pub. Date: Jul. 23, 2020

(65) Prior Publication Data

US 2021/0361094 A1 Nov. 25, 2021

(30) Foreign Application Priority Data

Jan. 14, 2019 (AR) ..... 20190100073

(51) Int. Cl.
*A47G 9/10* (2006.01)

(52) U.S. Cl.
CPC ..... *A47G 9/109* (2013.01); *A47G 9/1054* (2013.01); *A47G 2009/1018* (2013.01)

(58) Field of Classification Search
CPC ..... A47G 9/10; A47G 9/1054; A47G 9/1081; A47G 9/109; A47G 2009/1018
See application file for complete search history.

(56) References Cited

U.S. PATENT DOCUMENTS

| | | | | |
|---|---|---|---|---|
| 3,667,074 | A * | 6/1972 | Emery | A47G 9/109 5/636 |
| 5,727,267 | A * | 3/1998 | Keilhauer | A47G 9/109 5/636 |
| 6,671,906 | B1 * | 1/2004 | Milligan | A47G 9/109 5/636 |
| 6,817,049 | B1 * | 11/2004 | Hall | A47G 9/109 5/636 |
| 7,082,633 | B1 * | 8/2006 | Maarbjerg | A47G 9/10 5/636 |
| 8,893,334 | B1 * | 11/2014 | Wong | A47G 9/109 5/636 |
| 9,247,837 | B1 * | 2/2016 | Blake | A47G 9/1081 |
| 10,722,058 | B1 * | 7/2020 | Wagner | A47G 9/109 |
| 2007/0283495 | A1 * | 12/2007 | Ghani | A47G 9/10 5/636 |
| 2016/0058216 | A1 * | 3/2016 | White | A47G 9/10 5/636 |
| 2019/0313817 | A1 * | 10/2019 | Morden | A47G 9/1054 |

* cited by examiner

*Primary Examiner* — Peter M. Cuomo
*Assistant Examiner* — George Sun
(74) *Attorney, Agent, or Firm* — Davidson, Davidson & Kappel, LLC

(57) ABSTRACT

An anti-wrinkle anatomic pillow that allows that users rest on their backs, face down or on the side without this causing expression lines in their skins.

4 Claims, 2 Drawing Sheets

ANTI-WRINKLE ANATOMIC PILLOW

STATE OF THE ART OF THE INVENTION

This application is a U.S. national phase application of International Application No. PCT/I132019/060300, filed Nov. 28, 2019, which claims priority to Argentinian Patent Application No. AR 20190100073, filed Jan. 14, 2019, the disclosures of which are all hereby incorporated by reference herein.

Field of the Invention

The present invention belongs to the field of the devices, means or arrangements for people to rest or relax, preferably pillows, cushions, pads, etc. More in particular, the invention refers to an anti-wrinkle anatomic pillow made of a so-called "memory foam" material, namely a viscoelastic material, which pillow allows users to sleep on their side, face up or face down without causing expression lines in their skin. Even where this description refers to an anatomic pillow, it should be clearly understood that the design and construction hereof may be considered and used for different types of pillows, pads and cushions or the like, without any obstacles whatsoever. When referring to the "anti-wrinkle" properties hereof, this description aims at pointing out that the design and structure of the pillow hereof helps preventing the formation of wrinkles and in the best scenario effectively prevents the formation of wrinkles or facial marks.

Prior Art Description

Pillows are well known in the field of art and are known because they allow supporting a person's head for resting. Pillows are intended to keep the spine straight by filling the concavity of the neck in order to relax the neck, thus avoiding muscle tension and reducing the stress accumulated during the day. Pillows can be made of fiber, feather, latex or "memory foam" material.

Although conventional pillows made of fiber, feather or latex have proven that they can relatively help in people's resting, it is known that people do not always sleep in the same position or that they do not keep the same position while resting. For such reason, when users have changed their initial posture, they can wake up with muscular pain in the neck or the shoulders, even with a headache, besides showing expression lines in the skin.

In view of such inconvenience, a "memory foam" or memory material has been developed for making pillows. Said memory foam material usually consists of a viscoelastic foam that adapts to the head of a person when the person lies his or her head thereon, then returning to the original position when the pressure ceases.

Patent document U.S. Pat. No. 9,414,698 B2 discloses an incredibly soft, yet supportive, form-fitting head cradle that aids in consistent and comfortable back sleep while eliminating pressure on, or anything touching, the user's facial skin during sleep. This anti-wrinkle head pillow is a support designed to cradle the head and neck and keep anything from touching facial skin. It is made with a down or alternatively micro fiber materials. It has crescent-shaped head supports to deliver stability and comfort for successful nights sleeping without anything touching the face.

Patent document U.S. Pat. No. 9,247,837 B1 discloses an anti-wrinkle pillow having a back portion having a top edge and a bottom edge and side edges. The back portion has a forward surface and a rearward surface. A left side region and a right side region extend laterally from an associated side edge adjacent to the bottom edge. A perimeter is formed of the back portion and the left and right side regions. A left ear hole and a right ear hole are formed in the forward surface of the central region. A central recess is formed in the forward surface with the peripheral configuration following the perimeter of the back portion and the left and right side regions. The forward surface has a radially exterior extent and radially interior extent. The radial interior extent is formed by the central recess. The entire radially exterior extent is in a plane parallel with the rearward surface.

U.S. Pat. No. 5,848,448 discloses a pillow that does not promote facial wrinkling or earaches including a solid foam body. The body is sculptured to have hollows or cutouts positioned and specifically shaped on its longitudinal axis for receiving the facial tissue of a user so as to prevent wrinkles to the facial tissue.

U.S. Pat. No. 9,060,626 B2 discloses an anti-wrinkle pillow including a pillow casing, first recess and second recess. The pillow casing has a bottom and top and is filled with fill material. The first recess is formed by securing the bottom to the top and is disposed at a first location. The second recess is formed by securing the bottom to the top and disposed at a second location. The second location is at a predetermined distance from the first location, such that the first recess and the second recess define first and second raised portions delineated by a trough portion. The first and second raised portions are configured to contact first and second portions of a user's face. The through portion and the second recess are configured to remain contactless with the one or more portions of the user's face to mitigate wrinkling of the one or more portions of the user's face along the predetermined distance.

U.S. Pat. No. 8,572,780 B1 discloses a multi-use therapeutic pillow for the head that includes a cushioned frame having a central cavity that extends therethrough. A cushioned transverse member, operably coupled to the cushioned frame at its opposite ends, divides the central cavity into a lower cavity and an upper cavity. The lower cavity is larger than the upper cavity. In use, the multi-use therapeutic pillow is configured to protect and/or avoid contact with a sensitive anatomical structure, such as, the eyes, ears, nose, or mouth, while providing adequate support for the head.

U.S. Pat. No. 8,387,185 B2 discloses a space saver pillow system that comprises a space saver pillow and a bag. The space saver pillow includes a fill and a covering surrounding and enclosing the fill. The fill of the space saver pillow is adapted to generally rebound back to its natural state after being compressed. The bag encloses the space saver pillow and an amount of air. The space saver pillow enclosed in the bag is compressed no more than about 30% of its original size.

U.S. Pat. No. 8,161,588 B1 discloses an anti-aging pillow that provides, in the exemplary embodiment, a top surface providing a substantially central supine section flanked by an upwardly sloping left side section and a substantially symmetrical right side section, the left and right side sections elevated relatively higher than the supine section. The supine section is configured for accommodating a user when lying in a supine position, while each of the left and right side sections is configured for accommodating the user when lying in a respective side position. This configuration enables the pillow to both substantially prevent the user from unintentionally changing sleep positions as well as substantially assist in physically directing the user in selectively transitioning between each of the supine position and left and right side positions as desired, while substantially maintaining the user's head, neck, shoulders, and back in neutral alignment and substantially preventing facial contact with the pillow or underlying sleeping surface.

U.S. Pat. No. 7,434,281 B1 discloses a pillow for supporting the head of a user during sleeping that includes a main body formed of a resiliently compressible foam material in a generally rectangular configuration having opposite ends with opposed upper and lower surfaces extending between the opposite ends. The lower surface is configured to overlie stably on a sleeping platform, and the upper surface is formed with beveled indentations adjacent the opposite ends of the main body and with a convex contour extending lengthwise between the beveled indentations presenting a generally central crown area and inclined facial support areas respectively sloping downwardly away from the crown area toward the beveled indentations. Each facial support area is adapted to impart a pulling effect on the facial skin of a user when lying thereon in a downwardly sloping orientation with a cheek of the user's face on the facial support area and the user's face facing the adjacent beveled indentation.

U.S. Pat. No. 7,428,763 B2 discloses a pillow specifically used for eliminating any physical contact between a specific delicate skin area of a user's body part, a support surface, and the pillow, thus completely eliminating any possible contact between the specific delicate skin area and any associated object. For example, the specific delicate skin area may be the face of the user, the users body part being their head and the support surface being a bed. The pillow is so structured as to be removably, adjustably, and comfortably worn and attached onto any part of the users body and may also be made from numerous materials of choice.

U.S. Pat. No. 7,165,279 B1 discloses a pillow structured for preserving a user's facial beauty and includes a central portion, and upper and lower leg members extending from both the left and right sides of the central portion. The upper and lower leg members on each side are angled relative to one another to form a V-shaped gap. The upper and lower leg members support the user's head and neck, while the face remains over the V-shaped gap avoiding contact with the pillow, and thereby preventing distortion and wrinkling of the facial skin. A case that covers the facial beauty pillow may include straps, allowing the facial beauty pillow to be secured to a conventional pillow to adjust the resting height of the head according to the individual comfort level of the user.

U.S. Pat. No. 5,537,703 discloses a pillow which includes a first main face having an essentially planar main surface. This planar main surface includes a head receiving recess. The second main face of the pillow, located opposite the first main face, includes a plurality of extending fingers arranged in rows, wherein the fingers extend such that a base of the finger is located closer to the first main face than is the tip (or free end) of that finger. The fingers are of a length such that the finger tips essentially lie on a common plane which is essentially parallel, to the essentially planar main surface of the first main face. Several recesses are defined in the area between a finger and the surrounding, adjacent fingers of the second main face. In particularly preferred embodiments of the pillow, the recesses between adjacent fingers extend through the pillow so as to provide vent holes through the pillow in the area of the head receiving recess. These vent holes can be formed in a preferred embodiment which involves coordinating the depth of the head receiving recess with respect to the depth of the adjacent valleys so that the innermost end of certain valleys open out into the head receiving recess. The pillow is advantageously made from a polyurethane foam material.

U.S. Pat. No. 5,054,143 discloses an "anti-wrinkle" pillow that surpasses the limitations of prior art designs by keeping the delicate facial skin completely away from contact with the pillow and its covering when a person sleeps on his or her side. Instead of manipulating pressure or height, the present invention incorporates a tubular "extension piece" which is placed snugly under the jawbone, thereby providing better support rind comfort than prior art pillows and leaving the facial skin completely untouched.

Although the above-mentioned Patent Documents have proved that they can correctly operate in practice, there are still some inconveniences. Among these inconveniences, we point out that when users sleep on their side, the traditional pillows press the forehead, cheek, jaw and the eye area where, by the effect of gravity, exerts pressure; by remaining a few hours in that same position, expression lines become marked. In addition, many of the above-described pillows only allow sleeping on one's back, whereas, if the user sleeps on the side or face down, the pillows exert pressure on the facial skin, on the lower part of the cheek and expression lines are marked because the skin is soft and slides down with the pressure.

Moreover, some documents provide a design that is inconvenient for sleeping since the design is too rectangular and not adapted to the human anatomy, or they have too many shapes in order to hold the head, leaving little possibilities to find a simple and comfortable manner to sleep. In addition, these shapes do not provide one position in which no pressure is exerted from the forehead to the cheek, and where one section is left without pressure, the other section doe exert pressure. Additional, some of the designs heat the head.

Such being the state of the art available for resting, it becomes convenient to have a new pillow that allows people to rest both on the side, on the back or face down, without this causing expression lines in their skin, promoting a better rest and providing relief to the daily stress.

BRIEF DESCRIPTION OF THE INVENTION

An object of the present invention is therefore to provide a new anatomic anti-wrinkle pillow that allows people to sleep on their back, face down or on the side without this causing expression lines in their faces.

Another object of the present invention is to provide an anti-wrinkle anatomic pillow that provides relief to neck tensions.

Still another object of this invention is to provide an anatomic anti-wrinkle pillow that leaves a portion of the face of the user free from any contact with the pillow and/or the mattress.

Another object yet of the present invention is to provide an anti-wrinkle anatomic pillow that provides comfort and support to skull and neck.

It is yet another object of the present invention to provide an anti-wrinkle anatomic pillow that solves all the drawbacks of the prior art.

Another object of the present invention is to provide a pillow that may be made of a memory material, a memory foam o or a viscoelastic foam, feather, latex, fiber or a combination thereof.

It is yet another object of the present invention to provide an anti-wrinkle anatomic pillow comprising a shape of a rectangular plan having two lightly cutout corners, which could simulate the shape of a diaper or of lower undergarment, having at least one face or upper section for receiving a person's head and at least one side or lower section having a central depression which is accompanied by two lateral supports and by at least one support for the neck, such lateral supports and neck support being projected above said central depression, providing support for the head and the neck.

BRIEF DESCRIPTION OF THE DRAWINGS

For better clarity and understanding of the object of the present invention, it has been illustrated in only one figure, which represents the invention in its preferred embodiment, all furnished by way of example, wherein.

DETAILED DESCRIPTION OF THE INVENTION

Figure 4:
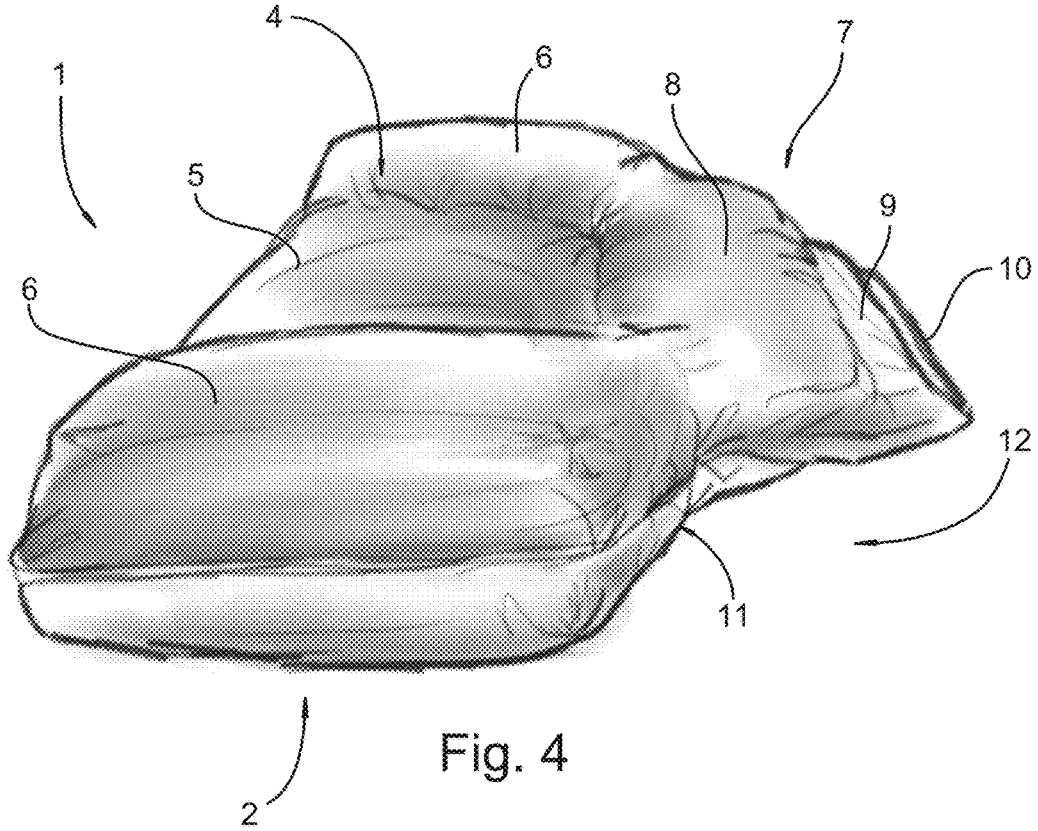
FIG. 4 shows a perspective and lateral view of the lower part of the pillow of the present invention.

Now referring to the figures, it is shown that the invention consists of a new anti-wrinkle anatomic pillow that allows users to rest on their backs, face down or on the side without this causing expression lines in their skins. Thus, according to FIGS. 1 through 4, the pillow of the present invention is hereafter referred to in general with the number 1 and it comprises a structure is generally shaped as a rectangular plan having two slightly cutout corners, simulating the shape of a diaper or of a lower undergarment, which has a face or upper section 2 for receiving the head 3 of a person, and at least one face or lower section 4 having a central depression 5, accompanied by two lateral supports 6 and at least one support for the neck 7. As it is shown in FIG. 4, both said lateral supports and the neck support are projected above said central depression 5.

Figure 1:
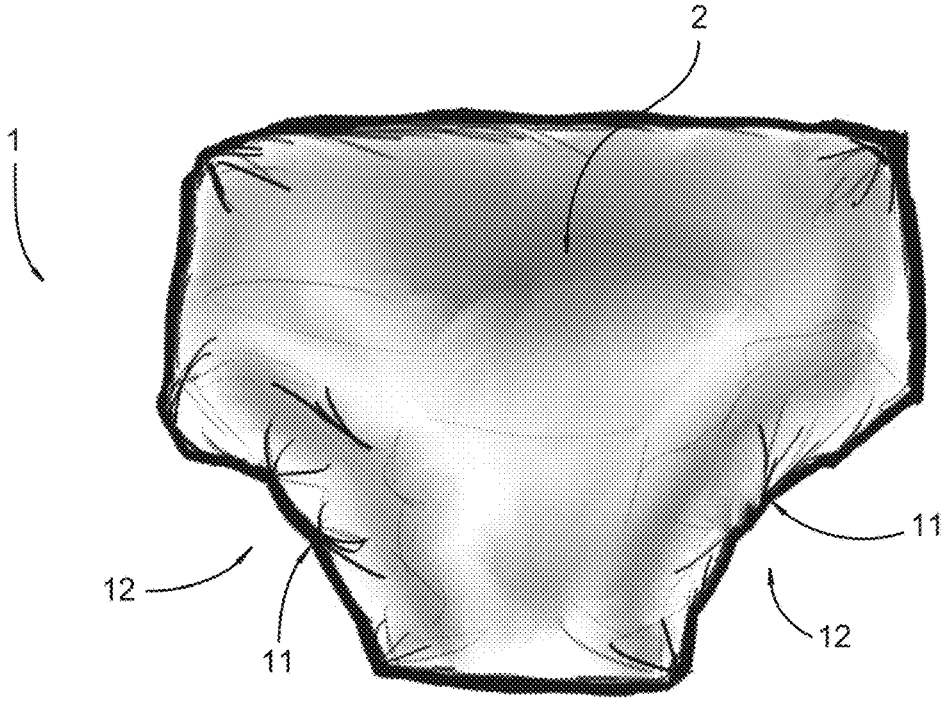
FIG. 1 shows a top view of the upper section of the pillow according to the present invention.
Figure 2:
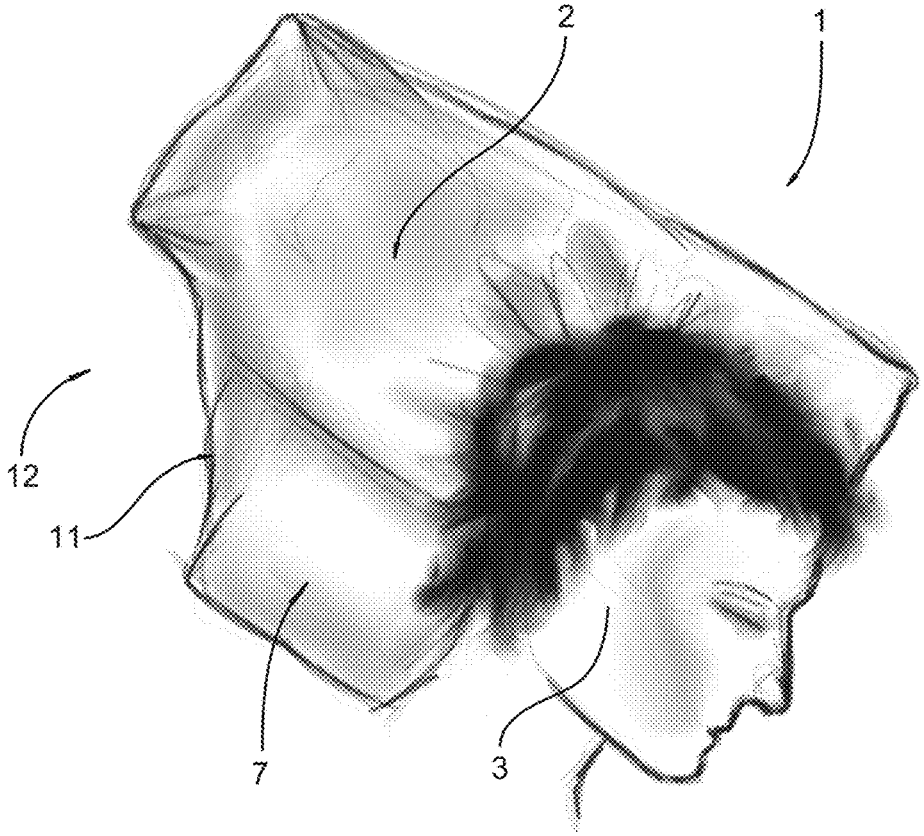
FIG. 2 shows a top view of the pillow of FIG. 1, showing the head of a person sleeping on the side.
Figure 3:
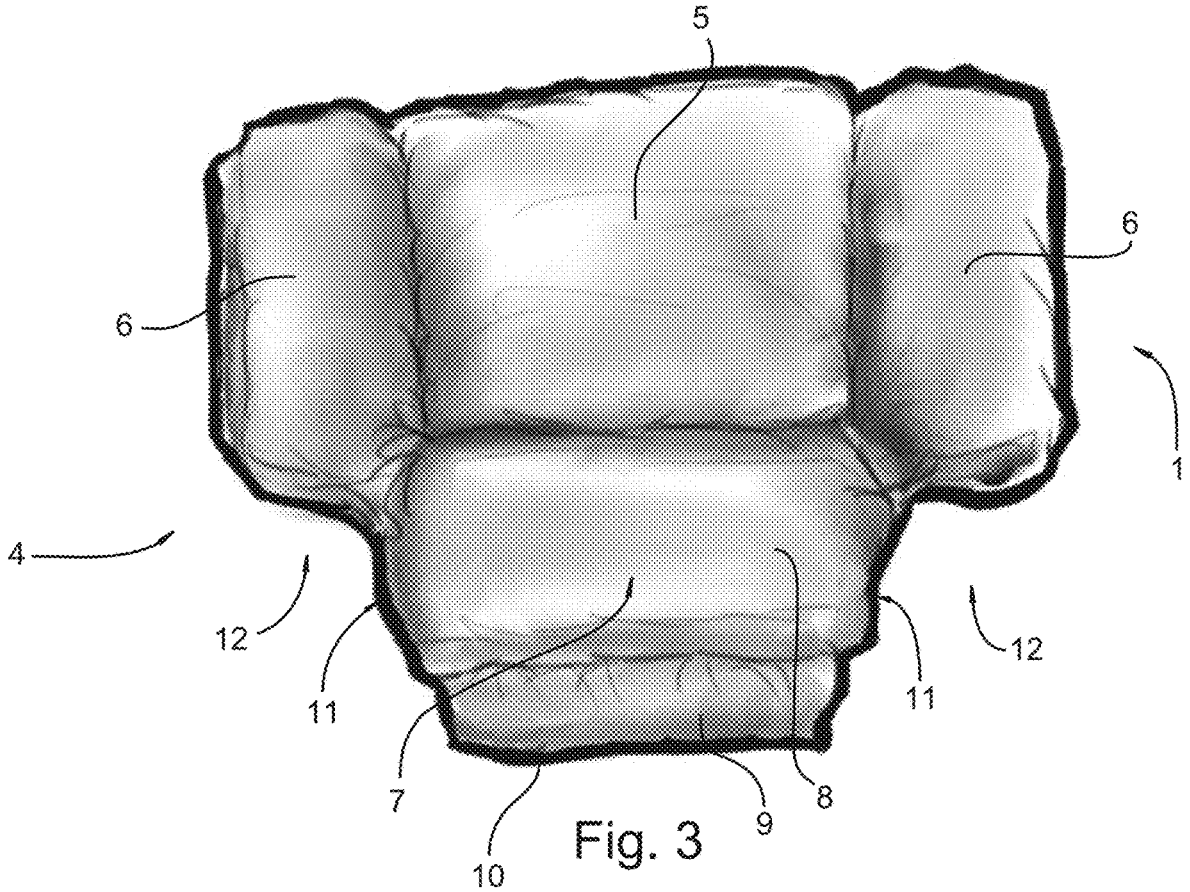
FIG. 3 shows a top view of the lower section of the pillow according to the present invention.

In turn, said neck support 7 has an upper support section 8 and a lower support section 9, which becomes narrower as it develops, defining a thinner, tapered stepped lower section 10 with respect to the upper support section 8. In addition, said lateral supports 6 and said neck support 7 are internally connected through their respective internal edges 11, whose internal development is curved and crescent-shaped. On the other hand, between said lateral supports 6 and said neck support 7 empty spaces or cutout spaces 12 are defined. In other words, the pillow includes a general shape as a rectangular plan having two slightly cutout corners 12, as shown in FIG. 1 wherein said inner edges 11 allow not having pressure in the forehead, cheek, jaw and eyes area, preventing the formation of expression lines. Said edges 11 are proportionately narrower at their upper section, disappearing towards a thicker part in the lower section. Causing pressure from the neck section to the jaw is thus avoided, preventing the creation of pressure in this area and the formation of expression lines.

In turn, the lateral supports allow supporting the head 3 so that it does not slide downwards and preventing that gravity causes that lowering the head exerts pressure over the forehead, cheek, jaw or the sides of the eyes when making contact with the pillow or the mattress. The rear section of this support has a smaller size than the frontal section in order to allow that the weight of the head to be supported but, at the same time, it does not allow a high bending of the neck, preventing that the person's neck twists and causes pain due to the height.

According to the invention, the body, the fill or inside of the anti-wrinkle anatomic pillow may be made of or constituted by any material known in the art, for example a material selected from the group comprising feather, latex, fiber, memory foam or viscoelastic foam, or a combination thereof. Preferably, in the present invention, viscoelastic foam is used because of its properties and characteristics, which are already well known in the field of art and, for such reason, no detailed description will be provided about them.

In addition, the pillow is sewn in such a manner that the corresponding sections are delimited between the lateral supports, the central depression and the neck support. Moreover, the pillow of the invention uses an external lining made of a tissue, such lining enclosing the viscoelastic foam. The lining may be made of cotton, polyester, satin or a mixture of materials, according to the preference of the user. Said material provides freshness and comfort, so that the person may rest even better.

If the pillow according to the invention is made of the material known as "memory foam", the body of such material can be molded as only one structure, or only one injected piece. The body of this material can be molded into a single structure, or a single injected piece. In that case, it could not be convenient to use seams, so other types of fasteners may be used, or seams may be used by sections. In any case, the thickness of the different parts of the pillow can be varied, and it can be thicker or thinner than the illustration hereof, either the whole piece, or it may vary at different sectors. Such different embodiments are, of course, within the scope of the invention.

Thus, the constitution of the anti-wrinkle anatomic pillow of the present invention allows the user to sleep face down, on the back or on the side, bearing the pressure of the skull but leaving the forehead, cheek, jaw and eyes area uncovered due to the crescent-shape void space in the pillow and, by means of the supports the pillow has in the skull area, the face is prevented from sliding downwards by the effect of the gravity.

The contrary happens with the conventional pillows of the previous art in which, when the user sleeps, the pillows press the forehead, cheeks, jaw and eye area which, by effect of the gravity cause pressure and, when staying a few hours in this position, expression lines become marked. In addition, the designs of the conventional anti-wrinkle pillows compel the users to sleep on their backs; or those pillows that allow the user to sleep on the side may leave uncovered certain areas of the skin, but they exert pressure on the forehead or the jaw, and expression lines are formed due to such pressure, since the skin is soft and it slides down by effect of the pressure.

Thus, the invention provides a comfortable and smooth pillow made of memory foam, which provides support for the head for sleeping comfortably, avoiding the pressure and the contact with the skin, the forehead, the cheeks, the jaw and the eyes area while sleeping. The pillow of the present invention allows users to sleep in different positions, on their backs, face down, on the sides, preventing that, when sleeping, the pressure and the effect of gravity cause the marking of expression lines in their skins.

In addition, the pillow allows the users' head to be comfortably supported during sleep, on the temporal bone, parallel to the eyebrow, so that the forehead, the cheek, the jaw, and the area of the eyes do not contact the pillow, the mattress or the tissue of the pillowcase, leaving such areas uncovered and avoiding any pressure on the skin and consequently, avoiding the formation of expression lines. The user may recline on the anti-wrinkle anatomic pillow of the present invention to watch TV or read but at the time of sleeping, the user can comfortably sleep on their backs, face down or on the side, according to their preference.

The invention claimed is:

1. An anti-wrinkle anatomic pillow comprising a general rectangular plan shape with two slightly cutout corners, simulating a shape of a diaper, also having:

at least one upper face for receiving a head of a person, and at least one bottom face opposite to the upper face, the bottom face having a central depression and accompanied by two lateral supports, with each lateral support being located at each side of the central depression, and at least one neck support, aligned with said central depression and extending beyond said lateral supports in a manner that said neck support and said lateral supports are connected by respective curved crescent shaped inner edges, with the curved crescent-shaped inner edges defining said cutout corners, said crescent-shaped inner edges are proportionately narrower at their upper section, disappearing towards a thicker part in their lower section, and wherein said lateral supports and said neck portion, at said bottom face of the pillow, project above said central depression, wherein the pillow is situated upon a mattress and may be covered by a pillowcase and wherein the lateral supports and the curved crescent-shaped inner edges support the person's head on the temporal bone, parallel to the eyebrow, wherein said curved crescent-shaped inner edges allow not having pressure in the forehead, cheek, jaw and eyes area, so that the forehead, the cheek, the jaw and the area of the eyes do not contact the pillow, the mattress or the tissue of the pillowcase to avoid pressure on the skin and the consequent formation of wrinkling of the skin.

2. The anti-wrinkle anatomic pillow according to claim 1, wherein said neck support, at the bottom face has an upper support section and a lower support section that becomes narrower as it is projected and defines a thinner, stepped lower section with respect to the upper support section.

3. The anti-wrinkle anatomic pillow according to claim 1, which is made of a material selected from the group consisting of feather, latex, fiber, memory foam, a viscoelastic foam, and combinations thereof.

4. The anti-wrinkle anatomic pillow according to claim 3, which is made of the viscoelastic foam.

* * * * *